US007497242B2

(12) United States Patent
Wang

(10) Patent No.: US 7,497,242 B2
(45) Date of Patent: Mar. 3, 2009

(54) WINDOW CURTAIN PULLING DEVICE

(76) Inventor: Chih-Yung Wang, No. 49, Renai Rd., Renhe Village, Linbian Township, Pingtung County (TW)

( * ) Notice: Subject to any disclaimer, the term of this patent is extended or adjusted under 35 U.S.C. 154(b) by 431 days.

(21) Appl. No.: 11/274,286

(22) Filed: Nov. 16, 2005

(65) Prior Publication Data

US 2007/0107857 A1 May 17, 2007

(51) Int. Cl.
*A47H 1/00* (2006.01)
*E06B 9/56* (2006.01)
*A47G 5/02* (2006.01)

(52) U.S. Cl. ..... 160/321; 160/238; 160/309

(58) Field of Classification Search ..... 160/168.1 V, 160/176.1 V, 177 V, 238, 309, 320, 321, 323.1; 192/15, 54.5, 93 A; 242/385, 385.2, 388.6, 242/688.8, 395
See application file for complete search history.

(56) References Cited

U.S. PATENT DOCUMENTS 4,372,432 A * 2/1983 Waine et al. ..... 192/223.4
5,507,374 A * 4/1996 Rude ..... 192/223.4
6,158,563 A * 12/2000 Welfonder et al. ..... 192/223.3
6,739,373 B1 * 5/2004 Liu et al. ..... 160/321
7,100,668 B2 * 9/2006 Allsop ..... 160/321
2005/0098673 A1 * 5/2005 Huang ..... 242/395
2005/0247413 A1 * 11/2005 Nien et al. ..... 160/321
2007/0056699 A1 * 3/2007 Liu ..... 160/321
2007/0084570 A1 * 4/2007 Lin ..... 160/321

* cited by examiner

*Primary Examiner*—Katherine W Mitchell
*Assistant Examiner*—Jeremy C Ramsey
(74) *Attorney, Agent, or Firm*—Muncy, Geissler, Olds & Lowe, PLLC

(57) ABSTRACT

A window curtain pulling device comprises a guide module, a pulling string wheel module, a rotary member module, a fixed casing, and a connecting component. A guide rod having a positioning ring passes through the rotary member module and latches the rotary member by a positioning ring. A pushing member coupled to the guide rod is latched with a fixed casing by a passing rod, such that an end of a pulling string at another side of a pulling string wheel module of the guide module is pulled to open a curtain, and another end of the pulling string is pulled once again. The rotary member includes a corresponding guide groove on one side and matches with a conical body of the pushing member, and the conical body is pushed by a slant of guide grooves of the coupling member pivotally coupled to the rotary member to rotate outward.

6 Claims, 9 Drawing Sheets

WINDOW CURTAIN PULLING DEVICE

FIELD OF THE INVENTION

The present invention relates to a pulling device, and more particularly to a pulling device for rolling a window curtain up or down smoothly to a fixed position.

BACKGROUND OF THE INVENTION

The present common curtain devices are used for shading sunlight or serving as a decoration, and these devices usually adopt a pulling string to roll the curtain up or down. However, such curtain is applicable for the Venetian curtain or the curtains that can be opened or closed sideway (from a left side or a right side), but it is not applicable for the one-piece curtains. The aforementioned curtain still has the following unsolved problems:

(1) The pulling string of the prior art curtain is pulled to the right slanting direction and then to a vertical direction, so that the curtain cloth can be opened completely. If the pulling string is pulled towards the right inclined direction, the pulling string will be stuck, and the whole curtain cloth will be rolled up to the top, and such pulling movement cannot fully control the curtain cloth to be opened or rolled up to a desired height.

(2) The prior art curtain cannot meet the user's requirements or roll the curtain cloth up or down to fix the curtain cloth to a desired height, and thus affecting the overall applicability of the curtain.

SUMMARY OF THE INVENTION

In view of the foregoing shortcomings of the prior art, the inventor of the present invention overcomes the shortcoming by providing a window curtain pulling device that passes a rotary member module through a guide rod of a guide module for the connection and providing users a way of separating or fixing a pushing member by driving a pulling string wheel module to push the rotary member module, so as to control a smooth movement of rolling up or down and fixing a curtain cloth.

By the structure of the foregoing window curtain pulling device, the following functions can be achieved: (1) A positioning ring 130 is latched to a rotary member of a rotary member module, and a pushing member is coupled to a guide rod, and a passing rod is latched with a fixed casing, such that an end of a pulling string of a guide module on the other side of the pulling string wheel module can pull and open a curtain cloth. (2) Another end of the pulling string of the pulling string wheel module on the other side of the guide module is pulled once again, and the rotary member of the rotary member module includes a corresponding guide groove that is matched with a conical body of a pushing member, and the conical body is pushed to rotate outward by the slanting surface of a guide groove of a coupling member pivotally coupled to the rotary member, so that the pushing member of the rotary member module is separated from the originally latched passing rod, and the fixed casing is in an idle state, such that the curtain cloth can be rolled up or down and fixed effectively.

DETAILED DESCRIPTION OF THE PREFERRED EMBODIMENTS

Figure 1:
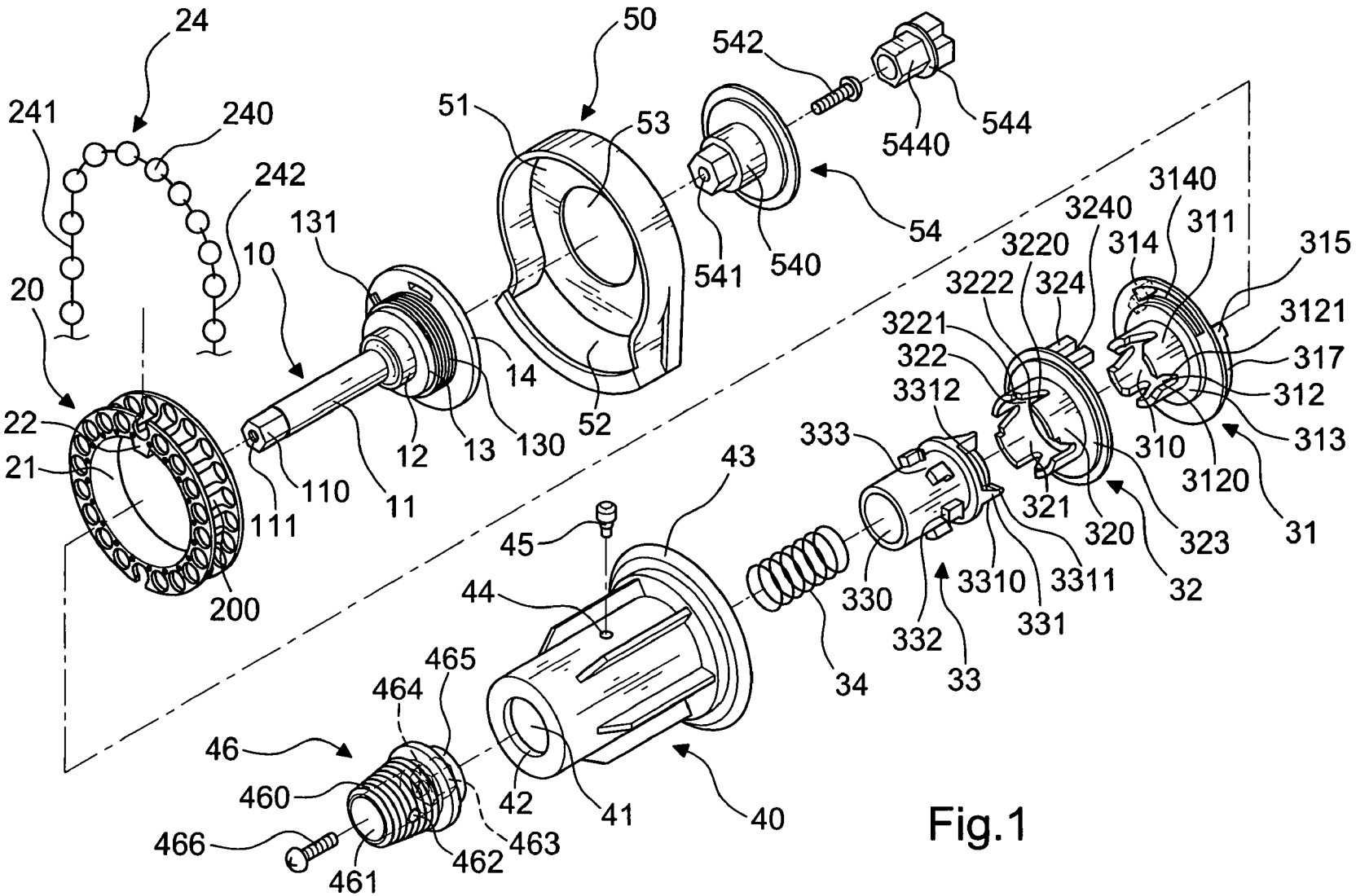
FIG. 1 is an exploded view of the present invention.
Figure 2:
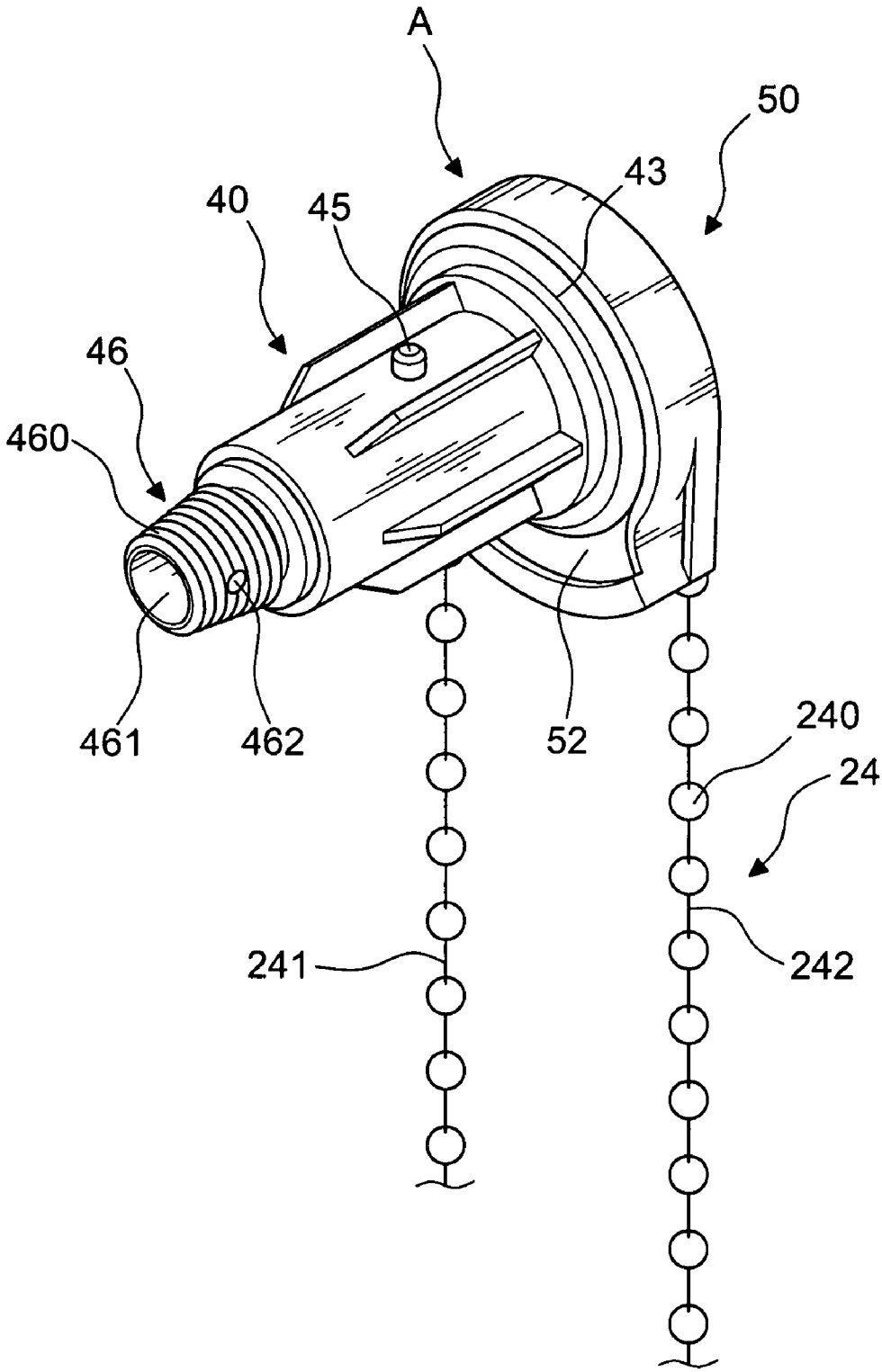
FIG. 2 is a perspective view of the present invention.
Figure 3:
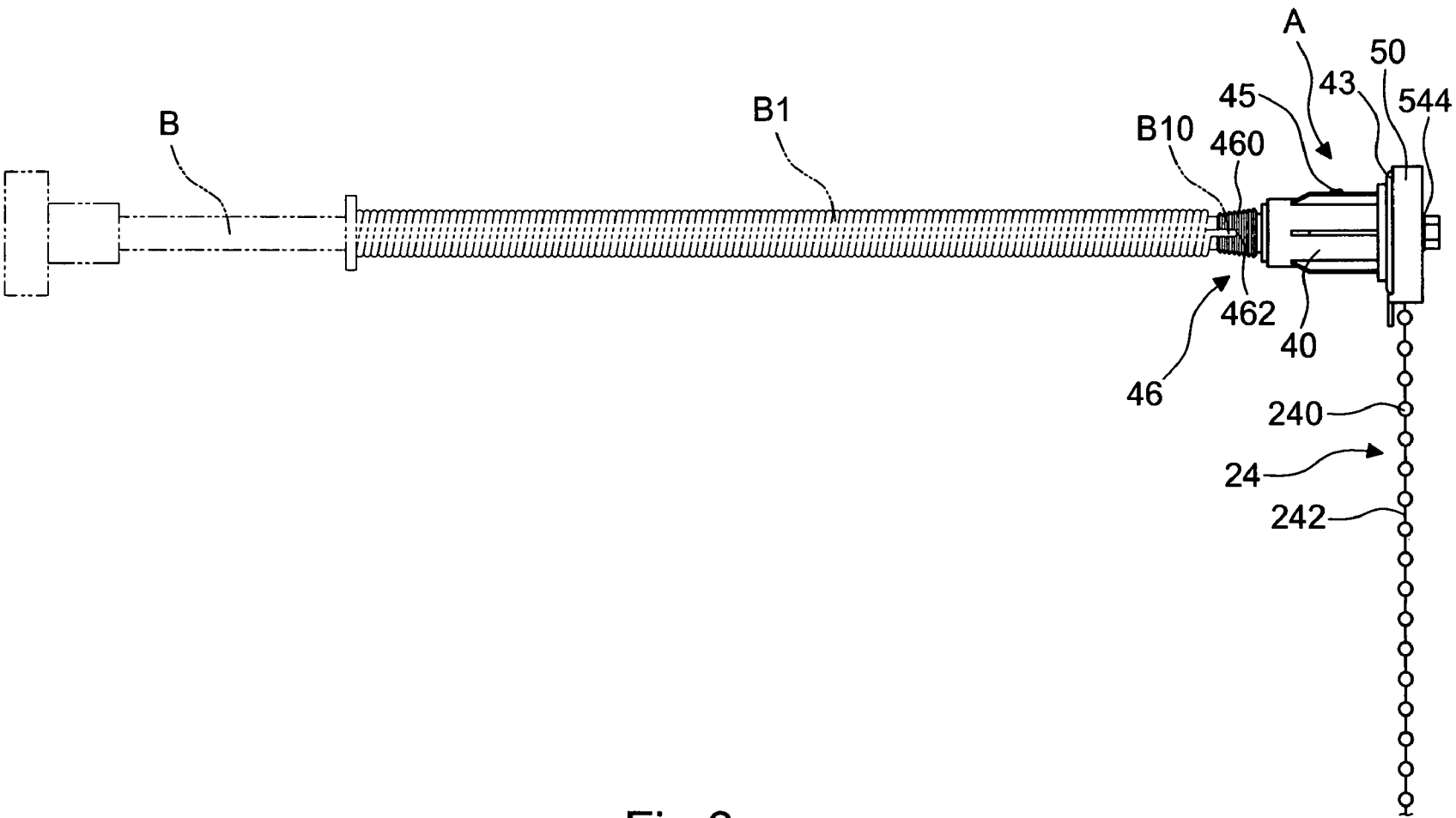
FIG. 3 is a schematic view of installing the present invention.
Figure 4:
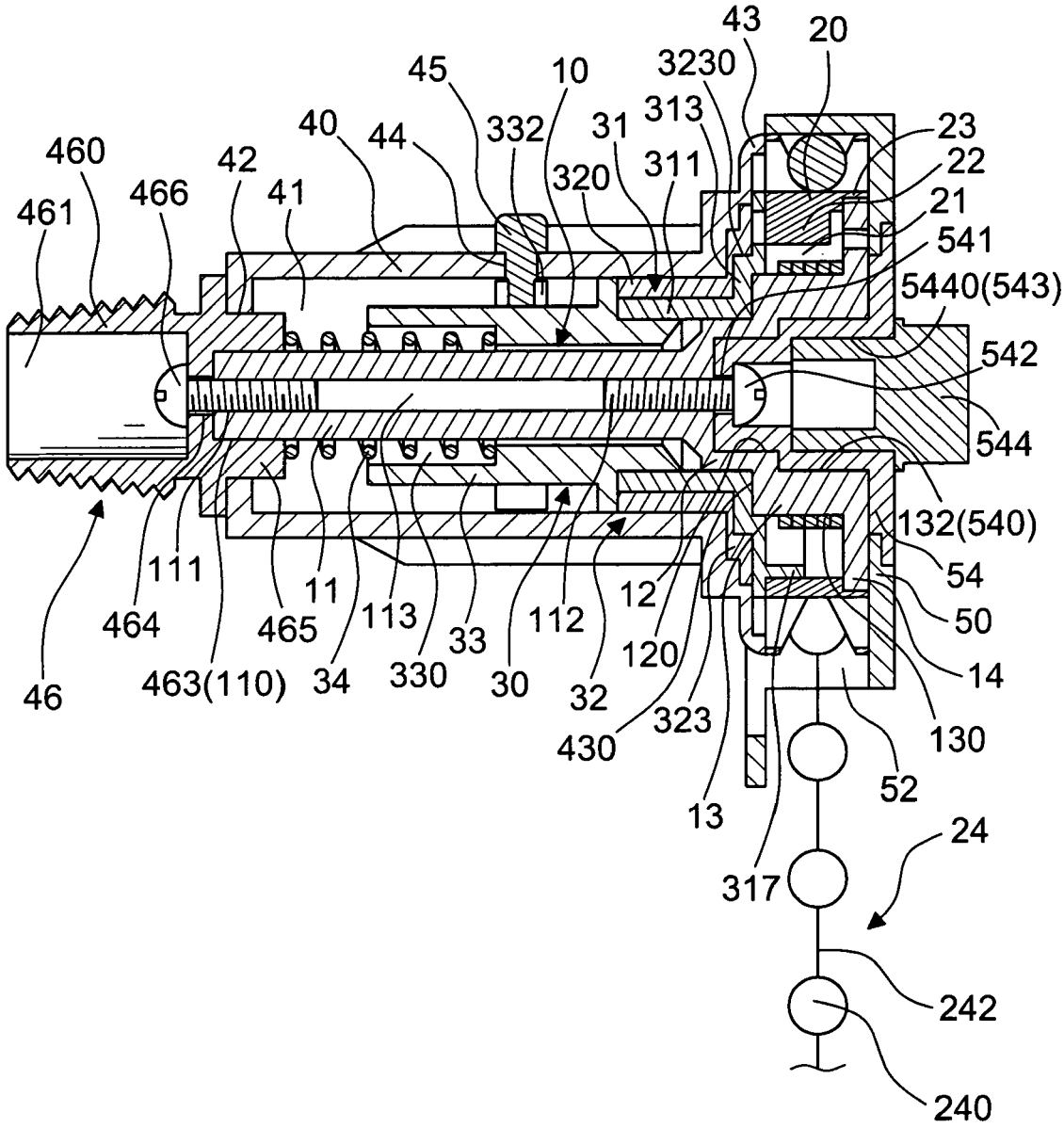
FIG. 4 is a cross-sectional view of the present invention.

Referring to FIGS. 1, 2, and 4, a locking member 46 disposed at an end of a window curtain pulling device A is latched with a resilient component B1 connected to an end B10 of axle rod B of a rail (as shown in FIG. 3), and the invention comprises a guide module 10, a pulling string wheel module 20, a rotary member module 30, a fixed casing 40, and a connecting component 50.

The guide module 10 includes a guide rod 11 at an end of the guide module 10, and the guide rod 11 includes a polygonal rod section 110 at the top of the guide rod 11, a projecting circular member 12, 13 having a different diameter and extended from an end, and the guide rod 11 includes a through hole 113 disposed at both ends in an internal thread hole 111, 112, and the external side of a projecting circular member 13 includes a positioning ring 130 having a protruded end 131 and a protruded wall 14 extended from another end, and the projecting circular member 12, 13 with a different diameter includes a polygonal internal hole 120 and a circular hole 132.

The pulling string wheel module 20 is connected to the exterior of a protruded wall 14 of the guide module 10, and the center of the pulling string wheel module 20 includes a through hole 21 for connecting the projecting circular member 12, 13 at an end of the guide module 10, and then a trapezoid latch 22 is extended from internal edge of the through hole 21, and a sunken surface 23 is extended from a side of the through hole 21 for installing the protruded wall 14 of the guide module 10, and the pulling string wheel module 20 includes a circular concave edge 200 disposed around the external periphery for installing the pulling string 24 with its corresponding beads 240.

Figure 5:
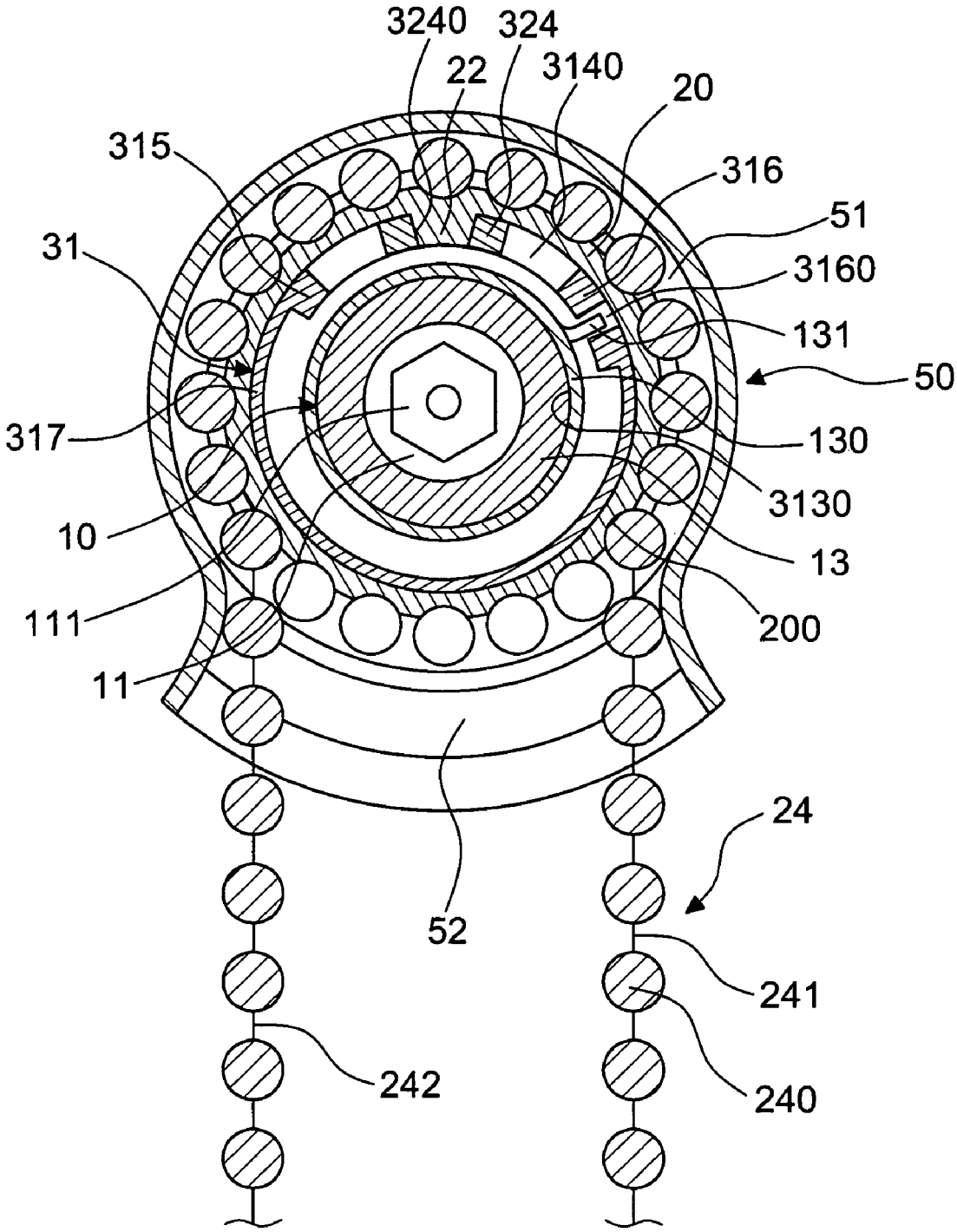
FIG. 5 is a right side view of a pulling device of the present invention.

The rotary member module 30 (as shown in FIG. 5) installed at the exterior of the guide rod 11 of the guide module 10 and disposed adjacent to the pulling string wheel module 20 comprises a rotary member 31, a coupling member 32, and a pushing member 33. The rotary member 31 includes a protruded rod 311 corresponding to a through hole 310, and the protruded rod 311 includes a corresponding guide groove 312 at its periphery and an end of the guide groove 312 is a plane 3120 and the other end is a slant 3121, and a protruded connecting member 313 having a containing space 3130 therein is extended outwardly from the protruded rod 311, and a flange surface 314 of two protrusions 316 having an arc slot 3140 and a latch 315 is separately disposed on both ends of its back and a space 3160 between the two protrusions 316, and an arc embedding member 317 is installed between the latch 315 and two protrusions 316 for connecting a projecting circular member 12, 13 at an end of the guide module 10 in the through hole 310 and the containing space 3130, and the protruded end 131 of the positioning ring 130 is installed in the space 3160 of the two protrusions 316, and the two protrusions 316 are provided for propping, and then the arc embedding member 317 is connected into the through hole 21 at the center of the pulling string wheel module 20. The coupling member 32 includes a sheathing rod 320 of the through hole 321 corresponding to the protruded rod 311 of the rotary member 31, and a guide groove 322 disposed around the periphery of the sheathing rod 320 and corresponding to the periphery of the protruded rod 311, and one end of the guide groove 322 is a plane 3220 and the other end is a slant 3222 having a propping end 3221, and a protruded connecting member 323 is extended outward from an end of the sheathing rod 320 and having a containing space 3230 therein, and two protrusions 324 having a space 3240 between the two protrusions 324 and disposed at the back of the protruded connecting member 323 and corresponding to the position of a plane 3220 of a guide groove 322, and this space 3240 is used for containing the trapezoid latch 22 at the internal edge of the through hole 21 of the pulling string wheel module 20 and connecting the protruded rod 311 at one side of the rotary member 31 with the protruded connecting member 313 in the through hole 321 and the containing space 3230. In the meantime, the two protrusions 324 at the back of the protruded connecting member 323 is rotated and passed through the space in the arc slot 3140 of the rotary member 31. Further, the interior of the pushing member 33 includes a rod section of a protruded through hole 330, and its external edge includes a conical body 331 corresponding to the guide groove 312, 322 of the rotary member 31 and the coupling member 32, and an end of the conical body 331 is a plane 3310 and the other end is a slant 3312 having a propping protruded end 3311. The central circumferential surface of the rod section includes a corresponding latching member 332 and a gap 333 disposed between the latching members 332, and thus the protruded through hole 330 passes out of the guide rod 11 of the guide module 10, and a resilient element 34 is sheathed into the protruded through hole 330, such that the resilience of the resilient element 34 moves the pushing member 33 and then pushes the pushing member 33 in a reverse direction so as to constitute a resuming force to return the pushing member 33 into its original position.

The fixed casing 40 (as shown in FIG. 4) is installed out of the guide module 10 and the rotary member module 30 and has a chamber 41 disposed at the center for connecting the rotary member module 30, a sheath hole 42 disposed at an end, and a protruded cover wall 43 having a plurality of sunken surfaces 430 at the other end, and the sunken surface 430 matches with the protruded connecting member 323 on the coupling member 32, and a penetrating hole 44 disposed at its periphery for inserting a passing rod 45, such that the passing rod 45 is restricted and latched in the gap 333 of the latching member 332 by the pushing rod 33. Further, the sheath hole 42 of the fixed casing 40 is coupled with a rod section 465 of a locking member 46, and the locking member 46 includes an internal hole 461 at an end and an external thread section 460 of the corresponding penetrating hole 462 disposed at its periphery, and the other end includes a polygonal internal hole 463 and a rod section 465 of a locking hole 464, and the polygonal internal hole 463 is provided for connecting the guide rod 11 at an end of the guide module 10 with the polygonal rod section 110 at the top.

The connecting component 50 (as shown in FIG. 4) is installed out of the pulling string wheel module 20 and includes a containing space 51 therein. A sectional arc groove 52 is disposed at the bottom of the containing space 51 for moving both ends 241, 242 of the pulling string 24 along the path of the arc groove 52, and the connecting component 50 includes a through hole 53 at a distal surface for installing a cover member 54. Further, a rod section 540 is extended from an end of the cover member 54 and coupled to the polygonal internal hole 120 and the circular hole 132 of a projecting circular member 12, 13 disposed at an end and having different diameters. The rod section 540 includes a penetrating hole 541 at its center for inserting a locking element 542, and the cover member 54 includes a polygonal internal hole 543 at an end of its interior for engaging a protruded tenon 544 at an end of the polygonal rod member 5440.

Referring to FIGS. 4 and 5 for the assembly of the present invention, the guide rod 11 at an end of the guide module 10 is passed out of the through hole 210 of the pulling string wheel module 20, and the protruded wall 14 of the guide module 10 is installed at the sunken surface 23 extended from a side of the through hole 21, and the through hole 321 of the coupling member 32 of the rotary member module 30 is coupled with the containing space 3230, the protruded rod 311 at a side of the rotary member 31, and the protruded connecting member 313 and extended to the guide rod 11. The two protrusions 324 at the back of the protruded connecting member 323 rotates and moves along the arc slot 3140 of the rotary member 31, and the space 3240 of the two protrusions 324 at the back of the protruded connecting member 313 are provided for containing the trapezoid latch 22 at the internal edge of the through hole 21 of the pulling string wheel module 20, and the protruded end 131 of the positioning ring 130 is latched into the space 3160 of the two protrusions 316, and the two protrusions 316 are used for propping, such that the coupling member 32 coupled to the pulling string wheel module 20 rotate synchronously. In the meantime, the pushing member 33 is extended to the guide rod 11, so that the conical body 331 at its external edge is coupled separately to the rotary member 31 and the guide groove 312, 322 of the coupling member 32. The top of the guide rod 11 installs a resilient element 34, and the chamber 41 of a fixed casing 40 having an end coupled to the locking member 46 contains the rotary member module 30 on the guide rod 11. A screw member 466 is passed through the locking hole 464 of the locking member 46 and locked into an internal thread hole 111 of the guide rod 11 at an end of the guide module 10, and the corresponding beads 240 of the pulling string 24 are placed at the circular concave edge 200 at the external periphery of the pulling string wheel module 20 and one side of the pulling string wheel module 20 is covered by the containing space 51 of the connecting component 50. The rod section 540 at an end of the cover member 54 is coupled to the polygonal internal hole 120 and the circular hole 132 of the projecting circular member 12, 13 having a different diameter with an end of the guide module 10, and the locking element 542 is passed through the penetrating hole 541 at the center of the rod section 540 and locked with the internal thread hole 112 at the other end of the guide rod 11 of the guide module 10. Finally, the polygonal rod member 5440 of the protruded tenon 544 is coupled with the polygonal internal hole 543 at an end of the cover member 54 to define a pulling device A, and the internal hole 461 at an end of the locking member 46 of the pulling device A is engaged with an axle rod B of a rail, and an end B10 of the resilient component B1 coupled to the axle rod B is passed and latched into the penetrating hole 462 corresponding to the periphery of the locking member 46 (as shown in FIG. 3).

Figure 6:
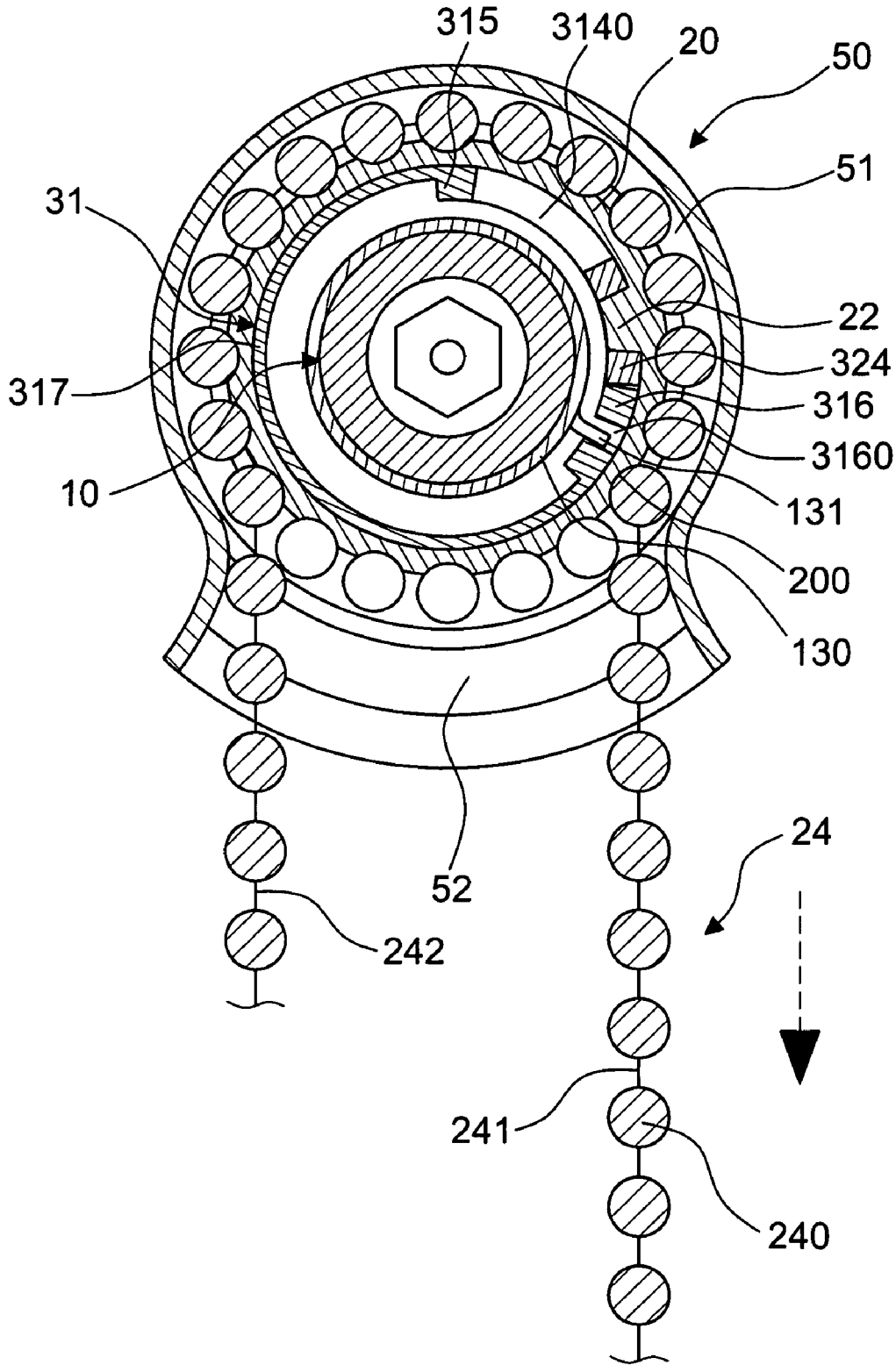
FIG. 6 is a schematic view of an application status of the present invention.
Figure 7:
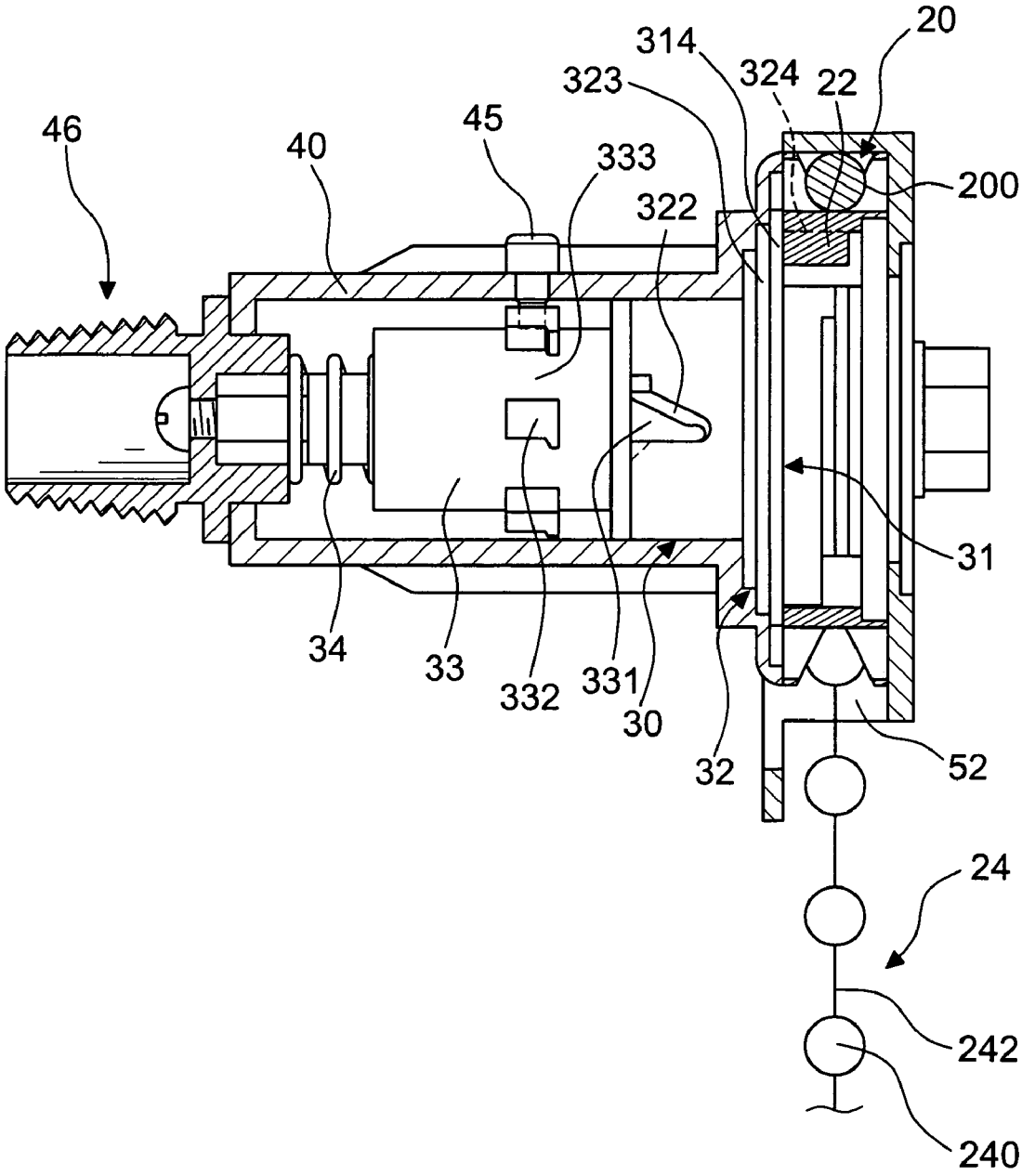
FIG. 7 is a cross-sectional view of fixing a pushing member according to the present invention.

Referring to FIGS. 6 and 7 for the actual application of the present invention, the pulling device A of the invention can be installed with any curtain device (not shown in the figure). If it is necessary to open a curtain cloth (not shown in the figure) by turning the pulling device A counterclockwise, then the passing rod 45 passed through the gap 333 of the latching member 332 of the pushing rod 33 will latch the pushing rod 33, so that the resilient element 34 at an end of the pushing member 33 will not be pressed. If the beads 240 at an end 241 of the pulling string 24 is pulled to rotate synchronously along the circular concave edge 200 of the pulling string wheel module 20. During the rotation, the trapezoid member 22 of the pulling string wheel module 20 drives the coupling member 32 of the rotary member module 30 to rotate, so that the coupling member 32 rotates in the arc slot 3140 of the rotary member 31 by the two protrusions 324 at the back of the protruded connecting member 323 and propped at one protrusion 316 at the back of the flange surface 314 of the rotary member 31, so that the conical body 331 at an end of the pushing member 33 is engaged with the guide groove 322 of the coupling member 32, and the locking member 46 latched at an end of the fixed casing 40 and coupled to the axle rod B of the rail is in an idle state, so as to pull and open the curtain cloth successfully.

Figure 8:
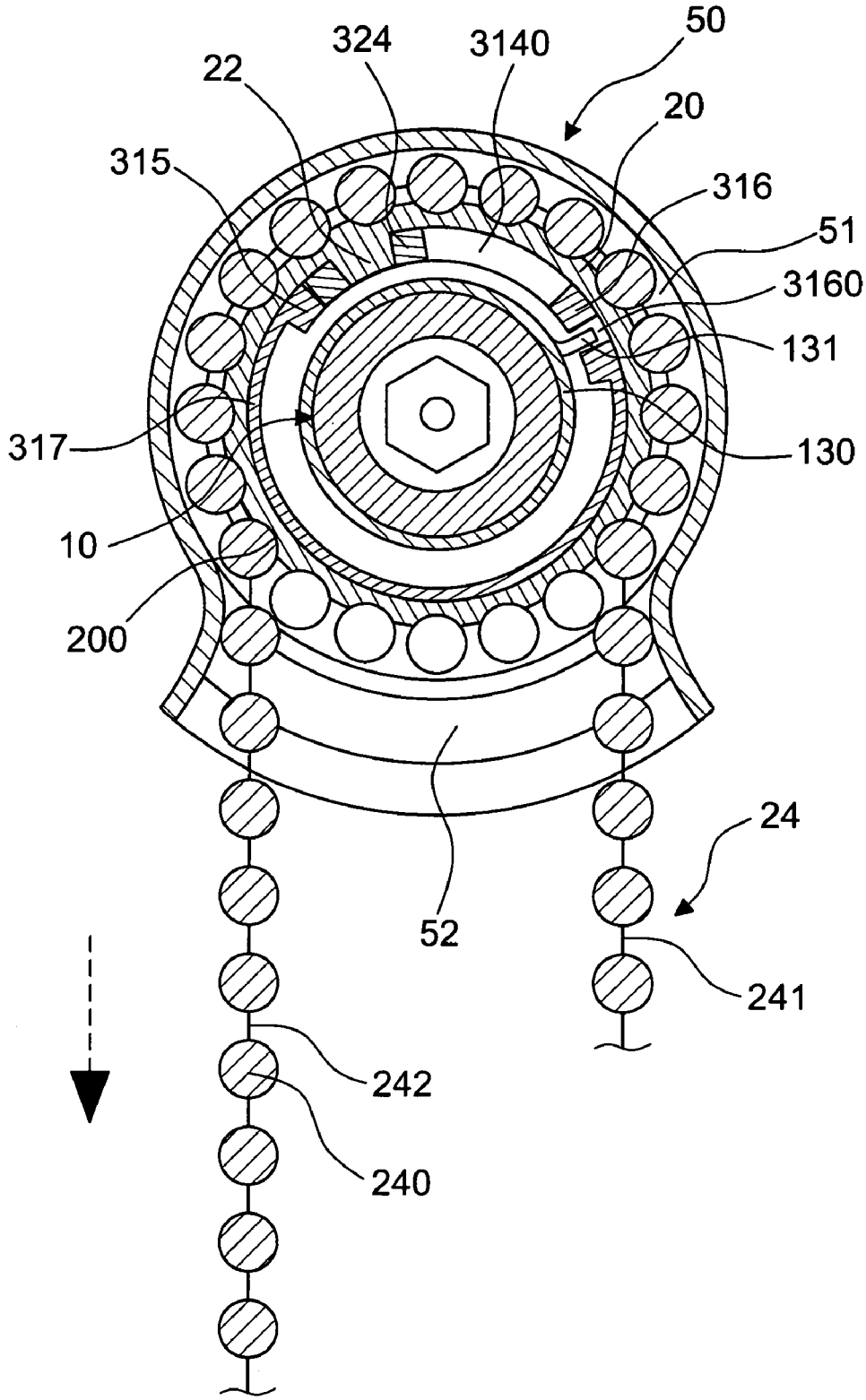
FIG. 8 is a schematic view of another application (rolling up) status of the present invention.
Figure 9:
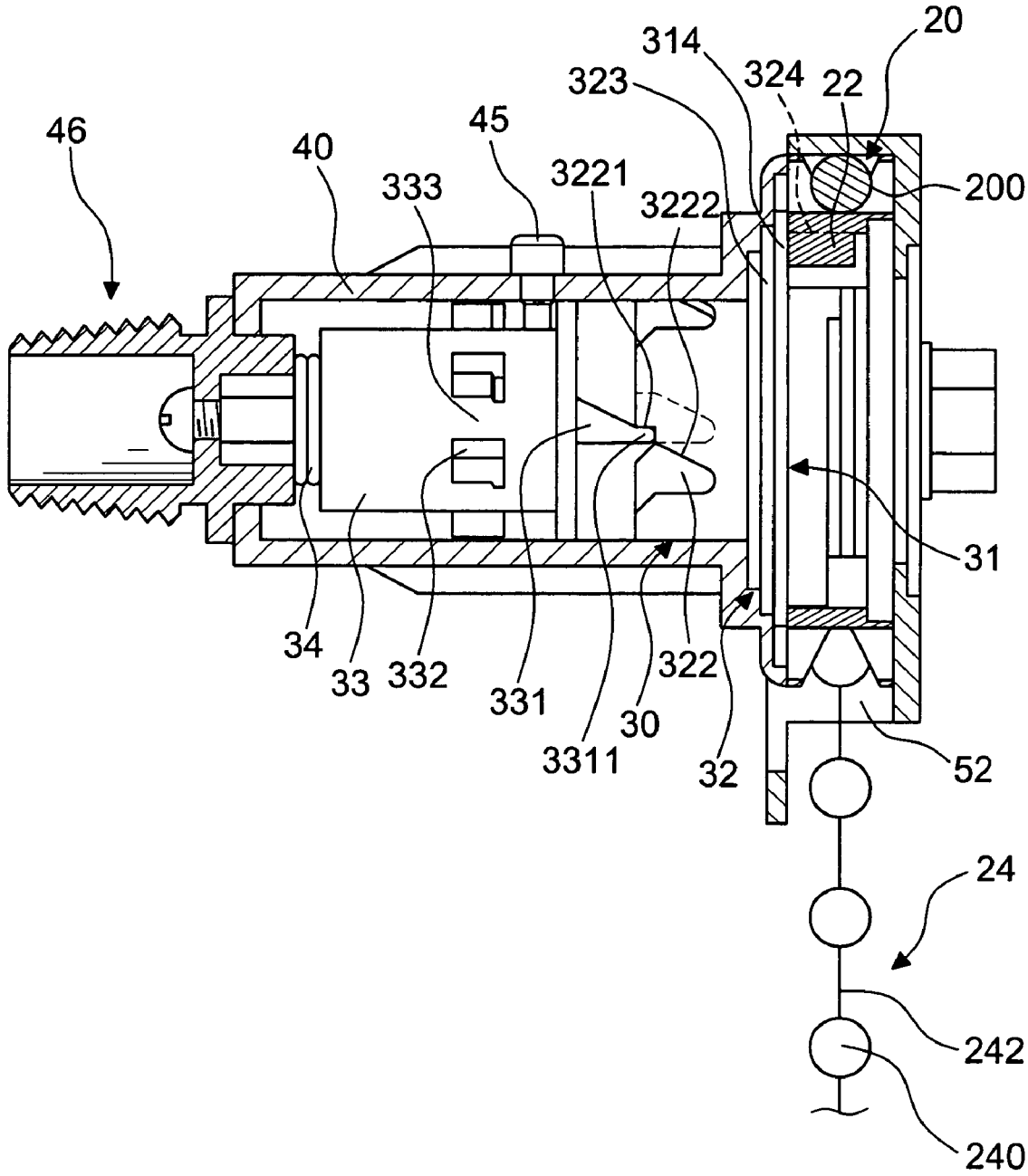
FIG. 9 is a schematic view of a pushing member being rotarily moved according to the present invention.

Referring to FIG. 8 for rolling up the curtain cloth (not shown in the figure) of the present invention by turning the pulling device A in a clockwise direction, the other end 242 of the pulling string 24 of the circular concave edge 200 of the pulling string wheel module 20 is pulled to drive the trapezoid latch 22 of the pulling string wheel module 20 in a reverse direction to rotate the coupling member 32 of the rotary member module 30, so that the coupling member 32 is rotated in the reverse direction in the arc slot 3140 of the rotary member 31 by the two protrusions 324 of the protruded connecting member 323, and propped at the latch 315 on the back side of the flange surface 314 of the rotary member 31. However, if the coupling member 32 rotates in the reverse direction, the slant 3222 of the guide groove 322 rotates the protruded end 3311 propped by the conical body 331 of the pushing member 33 outward (as shown in FIG. 9), so that the protruded end 3311 and the propping end 3221 of the guide groove 322 are in contact with each other, and the pushing member 33 of the rotary member module 30 is separated from the fixed passing rod 45 and the latched latching member 332. Now, the resilient element 34 at an end of the pushing member 33 is pressed, such that the fixed casing 40 is in an idle state, and the locking member 46 at an end of the fixed casing 40 is latched to the axle rod B of the rail. Since the resilient component B2 originally compressed by pulling the curtain cloth is resumed to its original position, the curtain cloth can be rolled and fixed effectively. Wriggles or damages will occur if the curtain cloth is rolled rapidly. When the curtain cloth is rolled up, it resumes to its pulling condition for pulling an end 241 of the pulling string 24 for the next time, so that if the resilience of the resilient element 34 at an end of the pushing member 33 is pressed, the pushing member 33 will be moved and pushed by the force in the reverse direction. As a result, the pushing member 33 is passed into the gap 333 of the latching member 332 by the passing rod 45, and the pushing rod 33 is restricted and latched again and resume to the original position as shown in FIGS. 6 and 7).

What is claimed is:

1. A window curtain pulling device, comprising:

a guide rod, disposed at an end of a guide module and having a through hole of an internal thread hole disposed on both ends of the interior of said guide rod, a polygonal rod section disposed at the top of said guide rod, and a projecting circular member with a different diameter disposed at an end of said guide rod, and a polygonal internal hole includes a circular hole therein;

a pulling string wheel module, sheathed outside a protruded wall of said guide module, and the center of said pulling string wheel module includes a through hole, and said through hole includes a trapezoid latch protruded from an internal edge of said through hole, and a sunken surface extended from one side of said through hole, and a circular concave edge disposed around the external periphery of said through hole;

a rotary member module, coupled to said guide rod of said guide module and disposed adjacent to said pulling string wheel module;

a fixed casing, passing through said guide module and said rotary member module and having a chamber disposed at the center of said fixed casing, a sheath hole disposed at an end, a protruded cover wall having a plurality of sunken surfaces disposed therein, and a penetrating hole disposed around the periphery;

a connecting component, coupled to the exterior of said pulling string wheel module and having a containing space therein, and said containing space includes a sectional arc groove disposed at the bottom of said containing space;

wherein said rotary member module comprises a rotary member, a coupling member, and a pushing member, and said rotary member includes a protruded rod corresponding to a through hole, and said protruded rod includes a periphery having a plane at an end, and a slant at the other end corresponding to a guide groove, and said protruded rod includes a protruded connecting member having an internal section with a containing space and two flange surfaces of a protrusion having an arc slot and two latches at both ends of the back side and a space between, and an arc embedding member is disposed between said latch and said protrusions, and said coupling member includes a sheathing rod of a through hole corresponding to said protruded rod of said rotary member, and said sheathing rod includes said guide groove disposed around the periphery of said protruded rod and corresponding to a plane at an end, and the other end includes a guide groove having a slant of a propping end, and said sheathing rod includes a protruded connecting member having a containing space in its interior, and said protruded connecting member includes two protrusions having a space between said two protrusions, and its back corresponding to a plane of said guide groove, and said pushing member includes a rod section of said protruded through hole having a resilient element passing through its interior, and said rod section includes a corresponding latching member disposed around the central circular periphery, and an end of the external edge includes a plane at an end corresponding to said rotary member and said guide groove of said coupling member, and another end includes a conical body of a slant having a propping protruded end.

2. The window curtain pulling device of claim 1, wherein said resilient element is a spring.

3. The window curtain pulling device of claim 1, wherein said sheath hole of said fixed casing is coupled to a rod section of a locking member.

4. The window curtain pulling device of claim 3, wherein said locking member includes an internal hole at an end, an external thread section of a corresponding penetrating hole disposed at its periphery, and said rod section disposed at another end and having a polygonal internal hole and a locking hole.

5. The window curtain pulling device of claim 1, wherein said connecting component includes a through hole disposed at a distal surface for coupling to a cover member.

6. The window curtain pulling device of claim 5, wherein said cover member is extended outward to a polygonal internal hole of said projecting circular member having a different diameter with an end of said guide module, and said circular hole is coupled to a rod section, which includes a penetrating hole at the center and the cover member includes a polygonal internal hole disposed at an internal end for engaging with a protruded tenon having a polygonal rod member at an end.

* * * * *